US011059303B2

(12) United States Patent
Ueno et al.

(10) Patent No.: US 11,059,303 B2
(45) Date of Patent: Jul. 13, 2021

(54) RECORDING MEDIUM HOLDER AND IMAGE FORMING SYSTEM

(71) Applicants: Satoshi Ueno, Tokyo (JP); Kazuyoshi Matsumoto, Tokyo (JP)

(72) Inventors: Satoshi Ueno, Tokyo (JP); Kazuyoshi Matsumoto, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/784,755

(22) Filed: Feb. 7, 2020

(65) Prior Publication Data

US 2020/0298591 A1 Sep. 24, 2020

(30) Foreign Application Priority Data

Mar. 19, 2019 (JP) ..... JP2019-050975

(51) Int. Cl.
*B41J 11/00* (2006.01)
*B41J 11/06* (2006.01)
*B41J 3/407* (2006.01)

(52) U.S. Cl.
CPC ..... *B41J 11/002* (2013.01); *B41J 3/4078* (2013.01); *B41J 3/40731* (2020.08); *B41J 11/06* (2013.01)

(58) Field of Classification Search
CPC ..... B41J 3/40731; B41J 3/4078; B41J 11/06; B41M 1/40
See application file for complete search history.

(56) References Cited

U.S. PATENT DOCUMENTS

2017/0320316 A1 11/2017 Nakamura et al.
2017/0320339 A1* 11/2017 Matsumoto ..... B41J 11/002
2018/0154656 A1 6/2018 Ueno et al.
2018/0217536 A1 8/2018 Obata et al.
2018/0313033 A1 11/2018 Yanase et al.

FOREIGN PATENT DOCUMENTS

JP 2016-020550 2/2016
JP 2016-108699 6/2016
JP 2016-108701 6/2016
JP 2018-084013 5/2018
JP 2019-026989 2/2019
JP 2019-206780 12/2019

* cited by examiner

*Primary Examiner* — Julian D Huffman
(74) *Attorney, Agent, or Firm* — Oblon, McClelland, Maier & Neustadt, L.L.P.

(57) ABSTRACT

A recording medium holder includes a base, a platen configured to hold a printing target portion of a recording medium, and a plurality of platen supports to support the platen. The plurality of platen supports is disposed side by side on the base. The plurality of platen supports includes a first platen support at one end and a second platen support respectively at one end and the other end of the plurality of platen supports. The first platen support the second platen support are separable from the platen.

11 Claims, 12 Drawing Sheets

RECORDING MEDIUM HOLDER AND IMAGE FORMING SYSTEM

CROSS-REFERENCE TO RELATED APPLICATION

This patent application is based on and claims priority pursuant to 35 U.S.C. § 119(a) to Japanese Patent Application No. 2019-050975, filed on Mar. 19, 2019, in the Japan Patent Office, the entire disclosure of which is hereby incorporated by reference herein.

BACKGROUND

Technical Field

The present disclosure relates to a recording medium holder and an image forming system.

Related Art

There are recording medium holders for holding, for example, cloth, as a medium on which an image is to be formed. Such a recording medium holder includes a base, a platen, and a peripheral cover (an outer cover). The platen holds the cloth so that a printing target portion (where an image is to be printed) of the cloth is kept flat. Further, the peripheral cover sandwiches the cloth together with the periphery of the platen. The recording medium holder includes an accommodation space for accommodating a surplus portion of the cloth between the platen and the base. The base of the recording medium holder includes a support to support the platen movably.

SUMMARY

According to an embodiment of this disclosure, a recording medium holder includes a base, a platen configured to hold a printing target portion of a recording medium, and a plurality of platen supports to support the platen. The plurality of platen supports is disposed side by side on the base. The plurality of platen supports includes a first platen support at one end and a second platen support respectively at one end and the other end of the plurality of platen supports. The first platen support the second platen support are separable from the platen.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
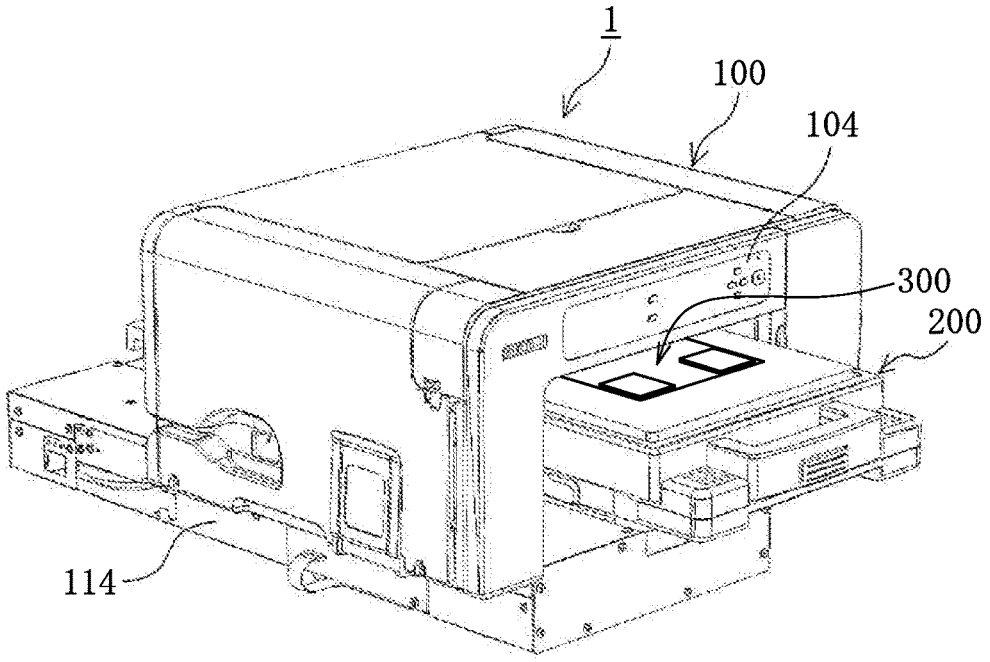
FIG. 1 is a perspective view illustrating an exterior of an example of a printer, as an image forming apparatus to form an image on cloth, according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

Referring now to the drawings, wherein like reference numerals designate identical or corresponding parts throughout the several views thereof, embodiments of this disclosure are described. As used herein, the singular forms "a", "an", and "the" are intended to include the plural forms as well, unless the context clearly indicates otherwise.

Figure 2:
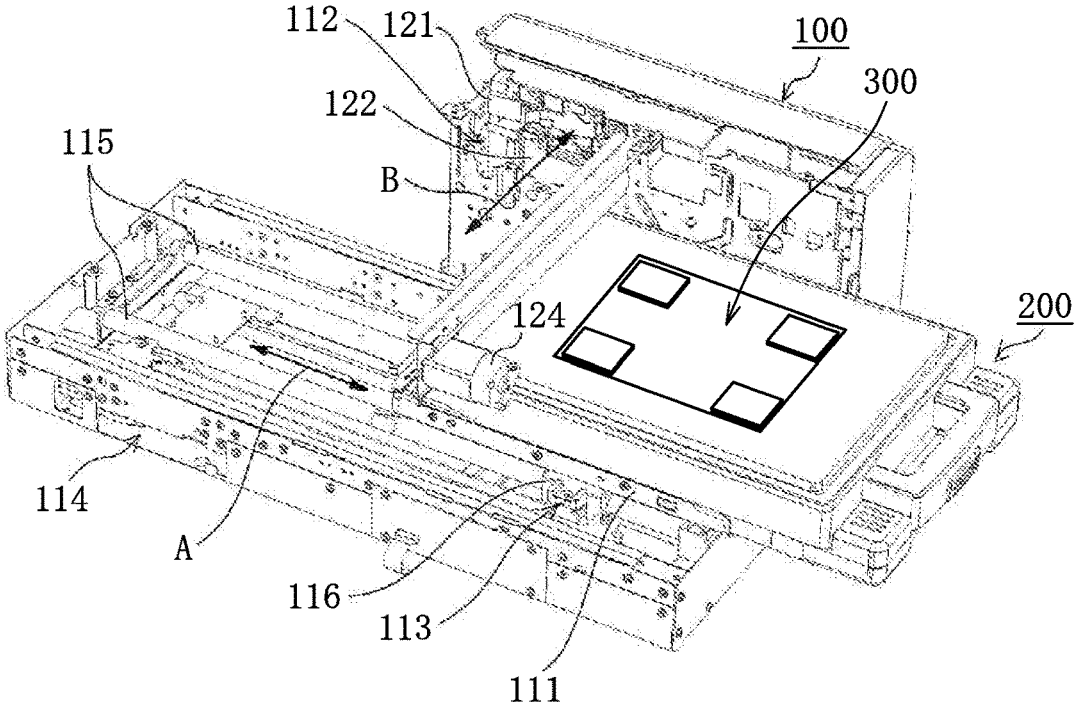
FIG. 2 is a perspective view illustrating a general arrangement of the printer illustrated in FIG. 1.
Figure 3:
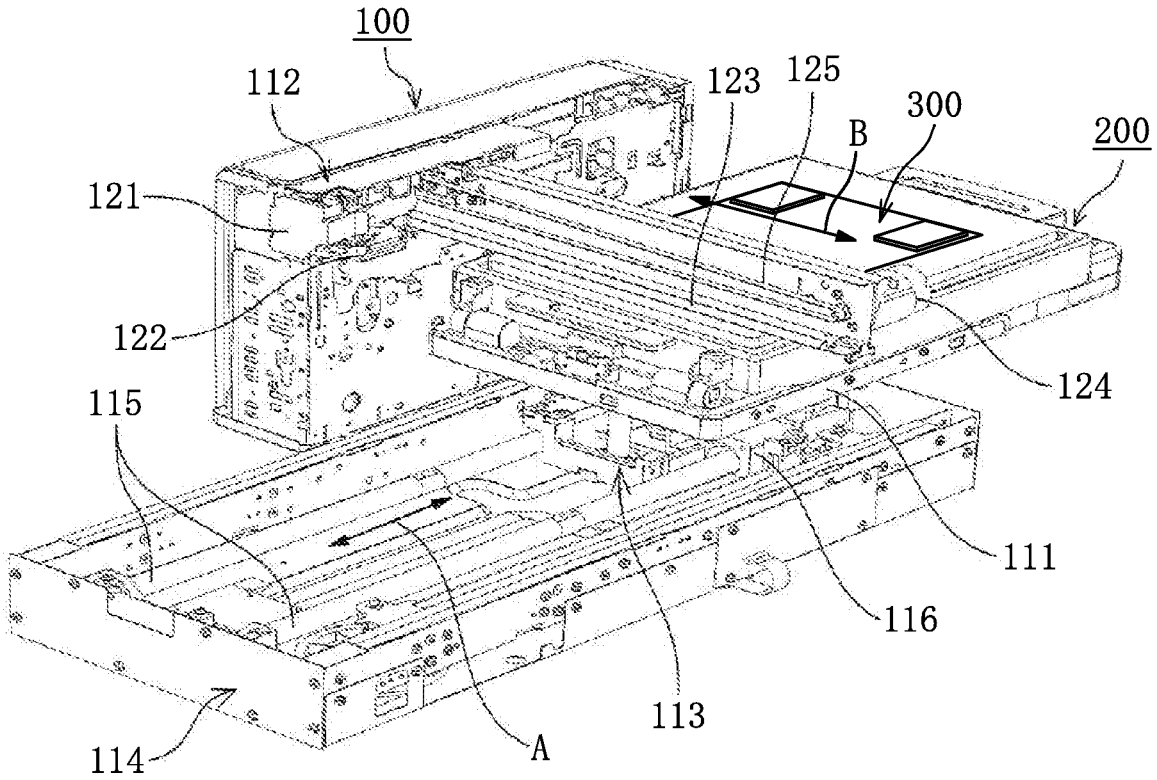
FIG. 3 is a perspective view of the printer as seen from a direction different from FIG. 2.

First, a description is given of a printer adopting aspect of the present disclosure with reference to FIGS. 1 to 3. The printer is an example of an image forming apparatus (an image applying system) to apply an image to cloth, according to the present disclosure. FIG. 1 is an exterior perspective view of the printer. FIG. 2 is a perspective view illustrating a general arrangement of the printer. FIG. 3 is a perspective view of the printer as seen from a direction different from FIG. 2.

As illustrated in FIG. 1, a printer 1 (an image forming apparatus) includes a cassette 200 removably mounted in a printer body 100. The cassette 200 is a tray (a recording medium holder) that holds a cloth 400 (a recording medium, see FIG. 6). The printer 1 prints (applies) an image on the cloth 400.

As illustrated in FIG. 2, the printer body 100 of the printer 1 includes a stage 111 (a mount), a printing device 112, a conveyance structure 113, and the like. The printer body 100 includes an operation panel 104. The stage 111 removably holds the cassette 200. The stage 111 can move forward and backward within the printer body 100. The printing device 112 prints an image on the cloth 400 held in the cassette 200. The stage 111 holds the cassette 200. The printer body 100 holds the conveyance structure 113 movably in the direction indicated by arrow A (feed direction, hereinafter "arrow A direction") relative to the printer body 100.

The cloth 400 is, for example, a piece of cloth, such as a handkerchief or towel, cloth manufactured as clothing, such as a T-shirt or a sweatshirt, or a fabric as a part of a product, such as a tote bag.

In the printer body 100, the stage 111 is on the conveyance structure 113. The printer body 100 includes a conveyance guide 115 disposed on a bottom casing 114 and along the arrow A direction. The conveyance guide 115 movably holds a slider 116 of the conveyance structure 113.

As illustrated in FIG. 3, the printing device 112 includes a carriage 121 and a head 122. The carriage 121 moves relative to the stage 111 in the direction indicated by arrow B (hereinafter "arrow B direction"), that is, a main scanning direction. The head 122 is mounted on the carriage 121. A guide 123 extending in the arrow B direction holds the carriage 121 movably. A drive motor 124 reciprocates the carriage 121 in the arrow B direction via a scanning mechanism such as a timing belt 125. In this example, the head 122 is a liquid discharge head to discharge ink onto a surface of a cloth to form an image. However, examples of the head are not limited to the liquid discharge head but may be any other suitable type of head.

As illustrated in FIGS. 1 to 3, in the printer 1, the cassette 200 is mounted and held on the stage 111 inside the printer body 100 with the cloth 400 (see FIG. 6) set in the cassette 200. Then, the stage 111 moves to one side in the direction indicated by arrow A, and the head 122 repeats reciprocal movement in the arrow B direction. Thus, the printer 1 prints a required image on the cloth 400.

Figure 4:
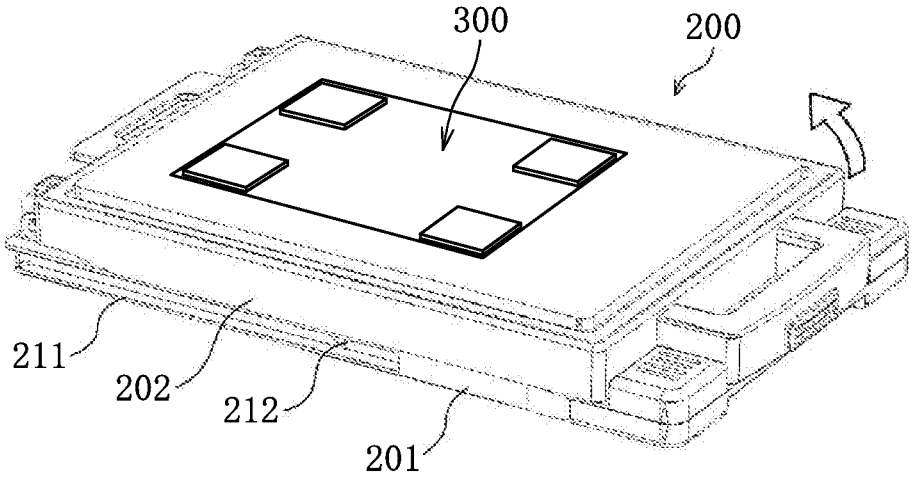
FIG. 4 is a perspective view of an example of a cassette of the printer.
Figure 5:
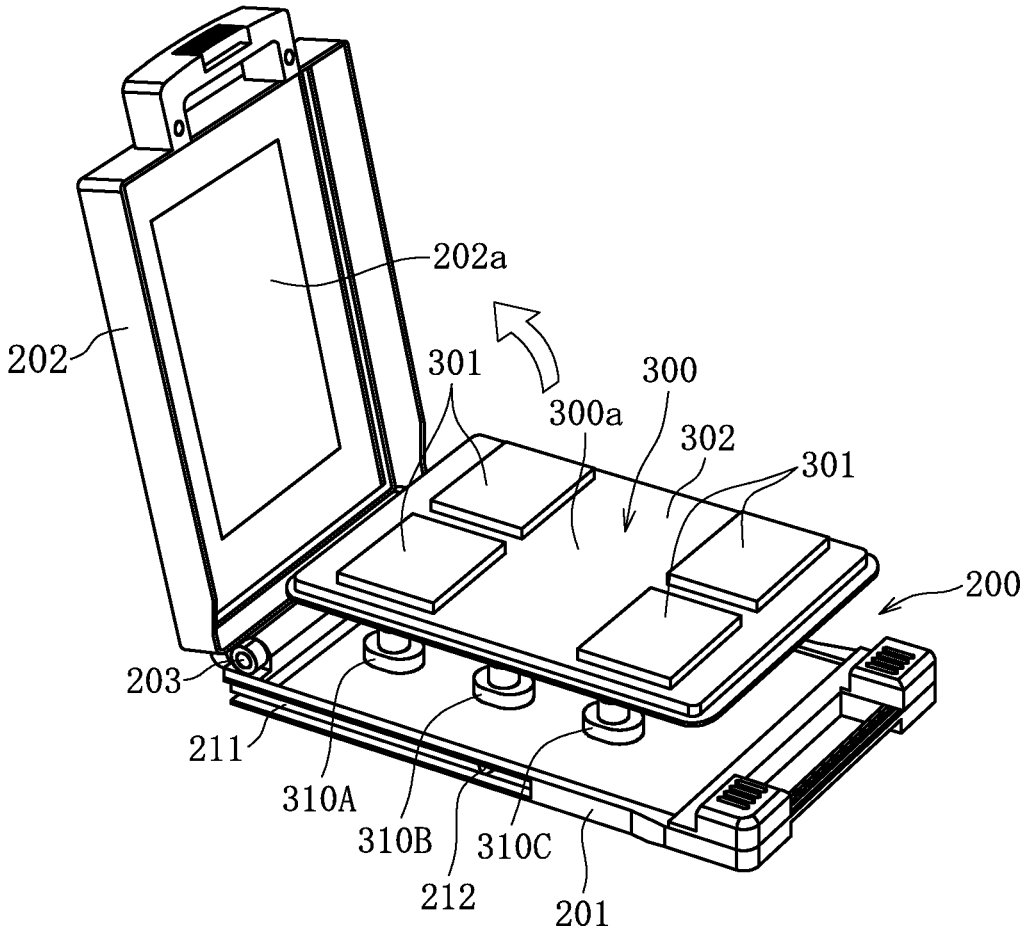
FIG. 5 is a perspective view illustrating a state in which a peripheral cover of the cassette illustrated in FIG. 4 is open.
Figure 6:
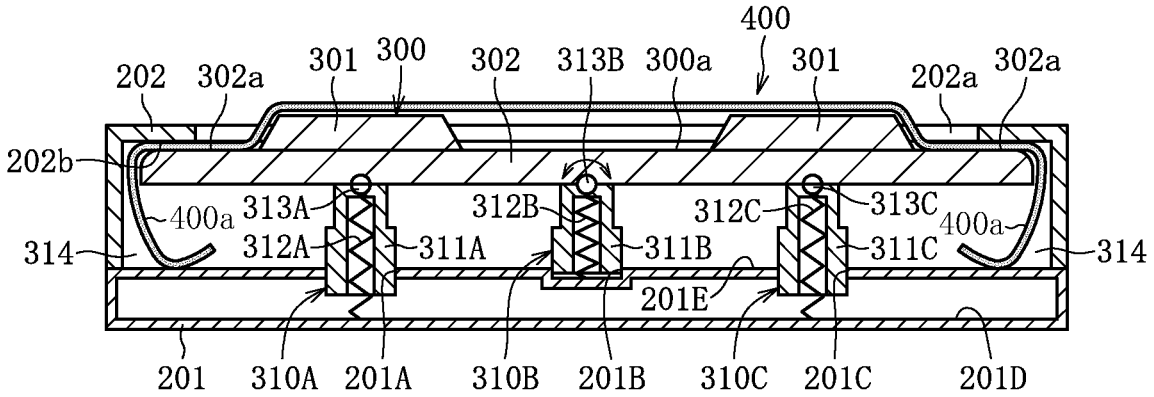
FIG. 6 is a cross-sectional view of the cassette cut along the short-side direction of the cassette.

Next, the cassette as the recording medium holder according to one embodiment of the present disclosure is described with reference to FIGS. 4 to 6. FIG. 4 is a perspective view of the cassette. FIG. 5 is a perspective view of the cassette in a state in which a peripheral cover is opened. FIG. 6 is a cross-sectional view of the cassette cut along the short-side direction of the cassette.

As illustrated in FIGS. 4 and 5, the cassette 200 includes a cassette base 201 (a base), a platen 300, and the like. The platen 300 holds the cloth 400 and keeps a printing target portion (where an image is to be printed) of the cloth flat.

The cassette base 201 includes a peripheral cover 202 (a clamp member or a cover). The peripheral cover 202 can pivot on a hinge 203 in the direction indicated by an arrow in FIG. 5 to open and close. The peripheral cover 202 includes an opening 202*a* to oppose the platen 300. The peripheral cover 202 sandwiches the cloth 400 together with a flange portion 302*a* (see FIG. 6) at the periphery of the platen 300. More specifically, with the peripheral cover 202 closed, a clamp face 202*b* of the peripheral cover 202 sandwiches the cloth 400 together with the flange portion 302*a*. The clamp face 202*b* is located on the opposite side of the platen 300 from platen supports 310A to 310C.

The platen 300 includes a platen body 302 and heat insulators 301 on the platen body 302. The heat insulators 301 provide mount faces that supports the cloth 400 in a flat state. There are four heat insulators 301 on an image formation side of the platen body 302. Two heat insulators 301 are disposed on each side in the direction in which the cassette 200 is inserted and removed from the printer 1. The platen 300 includes a recessed area 300*a* between the heat insulators 301 on one side and the heat insulators 301 on the other side. The upper face of the heat insulator 301 is flat.

Examples of the material of the heat insulators 301 include a heat-resistant sponge rubber made of, e.g., silicone rubber and fluorocarbon rubber, various heat-resistant resins, felt, calcium silicate plate, Kalhon, Kal Light, gypsum board, melamine sponge, glass wool, glass, and the like. These materials have heat resistance against heating by a fixing device 5 described later. Further, the platen body 302 requires a hardness for keeping the platen 300 flat and a certain degree of heat resistance. Therefore, a metal plate, a glass plate, or the like is suitable for the platen body 302. Note that the heat insulators 301 and the platen body 302 can be one component instead of being separate components.

The cassette base 201 includes a plurality of platen supports 310A to 310C (also collectively "platen supports 310") to support the platen 300. The platen supports 310A to 310C are arranged side by side in the insertion and removal direction of the cassette 200. Specifically, the cassette base 201 includes the platen supports 310A (platen supports at one end side) disposed on the downstream side, the platen supports 310C (platen supports at the other end side) disposed on the upstream side, and the platen supports 310B (intermediate platen supports) located between the platen supports 310A and 310C in the insertion and removal direction. In the cassette base 201, the two platen supports 310A, the two platen supports 310B, and two platen supports 310C are respectively lined in a direction perpendicular to the insertion and removal direction of the cassette 200 (a direction perpendicular to the surface of the paper on which FIG. 6 is drawn.

The platen support 310A includes a hollow support part 311A, a spring 312A, and a connection part 313A. One end side (lower side in FIG. 6) of the hollow support part 311A penetrates a hole 201A in the cassette base 201 and extends inside the cassette base 201. Further, the other end side (upper side in the figure) of the hollow support part 311A can be coupled to the platen 300 via the connection part 313A. The cassette base 201 holds the hollow support parts 311A so as to be able to move relative to the cassette base 201 in the vertical direction in the drawing. The spring 312A is disposed inside the hollow support part 311A. One end of the spring 312A is fixed to an inner face 201D of the cassette base 201. The other end of the spring 312A is fixed to an inner face of the hollow support part 311A on the upper side in the drawing. The spring 312A urges the hollow support part 311A upward in the drawing. The hollow support part 311A can connect and disconnect the connection part 313A to and from the platen 300. The connection part 313A can be, for example, an engagement portion that is paired with an engagement portion of the platen 300 disposed corresponding to the connection part 313A. The platen supports 310C has the same configuration as the platen supports 310A. The hollow support part 311C penetrates a hole 201C in the cassette base 201 and extends inside the cassette base 201.

The platen support 310B includes a hollow support part 311B, a spring 312B, and a fulcrum 313B. One end side of the hollow support part 311B is disposed inside a recess 201B on an upper face 201E of the cassette base 201. The hollow support part 311B further includes the fulcrum 313B on the other end side. The hollow support part 311B supports the platen 300 with the fulcrum 313B. The hollow support part 311B is integral with the platen 300 and moves together with the platen 300 in the vertical direction in the drawing relative to the cassette base 201. Further, the platen 300 is pivotable on a virtual axis passing through the fulcrum 313B in the direction perpendicular to the surface of the paper on which FIG. 6 is drawn. One end of the spring 312B is fixed to the recess on the upper face 201E of the cassette base 201. The other end of the spring 312B is fixed to an inner face of the hollow support part 311B on the upper side in the drawing. The spring 312B urges the hollow support part 311B upward in the drawing.

The platen supports 310A to 310C support the platen 300, so that clearances are secured between the platen 300 and the cassette base 201. Of the clearances, clearances on both sides in the insertion and removal direction (lateral direction in the drawing) of the cassette 200 are accommodation spaces 314 that can accommodate surplus portions 400*a* of the cloth 400. For example, when an image is printed on the front side of a T-shirt, the surplus portions 400*a* are sleeves, a neck, a hem, or the like of the T-shirt.

The platen 300 is removably attached to the cassette base 201 and is replaceable. Thus, a user (or operator) can prepare a plurality of platens 300 and wind a next cloth around another platen 300 during a printing operation on one of the clothes. Therefore, the printer can immediately start printing on the next cloth as the user simply replaces the platen 300 after printing and fixing of an image on a certain cloth.

First, a case where printing is performed on the front or back side of the T-shirt as the cloth 400 is described.

When setting the cloth 400 in the cassette 200 to be held therein, as illustrated in FIG. 5, the user opens the peripheral cover 202 and sets the cloth 400 on the platen 300 (on the heat insulators 301). At this time, in a state where the surplus portions 400*a* of the cloth 400 are accommodated in the accommodation spaces 314 as illustrated in FIG. 6, the user closes the peripheral cover 202 as illustrated in FIG. 4.

The cassette 200 sandwiches the cloth 400 between the peripheral cover 202 and the platen 300, thereby holding the cloth 400 in the cassette 200. Then, the cassette 200 can hold the cloth 400 at a predetermined position in the cassette 200 at the time of printing, heating, or the like. Further, the cassette 200 can secure the flatness of the printing target portion (on which an image is formed). Therefore, the quality of printing improves. Even when a user carries the cassette 200, the cloth 400 is less likely to move in the cassette 200. Since the peripheral cover 202 that forms the outer peripheral frame of the cassette 200 is used to sandwich the cloth 400 together with the platen 300, the number of components of the cassette 200 can be reduced. Further, as the user closes the peripheral cover 202, simultaneously, the cloth 400 can be sandwiched between the peripheral cover 202 and the platen 300.

In the present embodiment, the hollow support parts 311A to 311C and the platen 300 coupled to the hollow support parts 311A to 311C are movable in the vertical direction in the drawing relative to the cassette base 201. With such a configuration, the cassette 200 can change the supporting height (the height in the vertical direction in the drawing) of the platen 300 relative to the cassette base 201. Therefore, the printer 1 can perform a printing operation with high accuracy on the cloth 400 having various thicknesses. That is, even when the cloths 400 having different thicknesses are accommodated, the cassette 200 can change the size of the gap between the peripheral cover 202 and the platen 300 according to the thickness of the cloths 400.

In particular, in the present embodiment, the platen 300 is urged upward in the drawing by the springs 312A to 312C in the platen supports 310A to 310C, thereby automatically adjusting the gap between the platen 300 and the peripheral cover 202 according to the thickness of the cloth 400 to be clamped. For example, when a user attempts to close the peripheral cover 202 with the thick cloth 400 accommodated therein, the peripheral cover 202 pushes down the platen 300 against the urging force of the springs 312A to 312C and moves to the closed position illustrated in FIG. 6. Thus, the cassette 200 can appropriately accommodate the cloth 400 between the peripheral cover 202 and the platen 300.

Further, the hollow support parts 311A and 311C are movable in the vertical direction in the figure relative to the cassette base 201, so that the hollow support parts 311A and 311C can move in the vertical direction in accordance with the pivoting (rotation) of the platen 300 (details will be described later).

In the present embodiment, the biasing forces exerted by the springs 312A to 312C are set to be substantially the same. However, the biasing force of the spring 312B may be set weaker than those of the other springs 312A and 312C. Thus, the cassette 200 can more reliably sandwich the cloth 400 between the peripheral cover 202 and the flange portion 302*a* of the platen 300.

Then, when the printer 1 prints an image on the cloth 400, as illustrated in FIG. 1, the user mounts (sets) the cassette 200 on the stage 111 of the printer body 100 of the printer 1.

In this manner, the user can set the cloth 400, as a printing target, on the platen 300 in a state where the entire cassette 200 is pulled out from the printer body 100. Therefore, the work of setting the cloth 400 on the platen 300 becomes easy.

Figure 10:
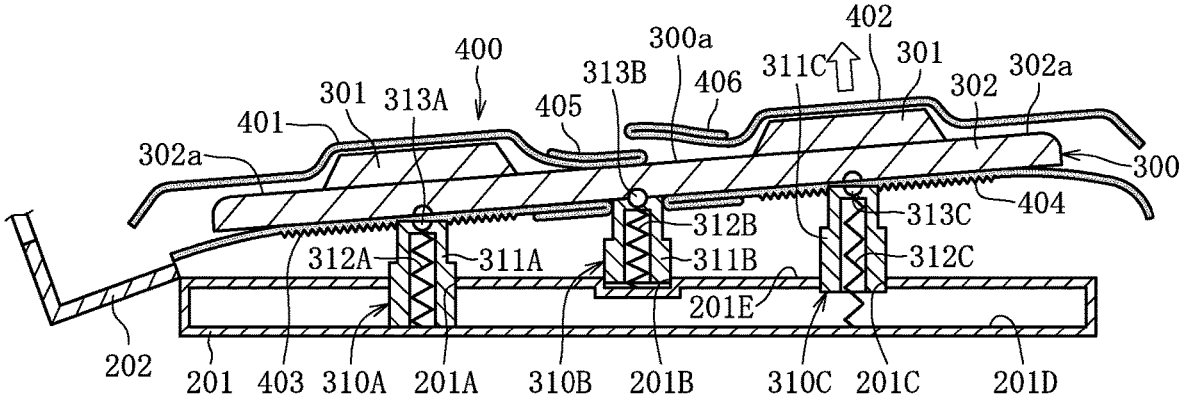
FIG. 10 is a cross-sectional view of the cassette cut along the short-side direction of the cassette and illustrating a state in which another sleeve is set therein.
Figure 11:
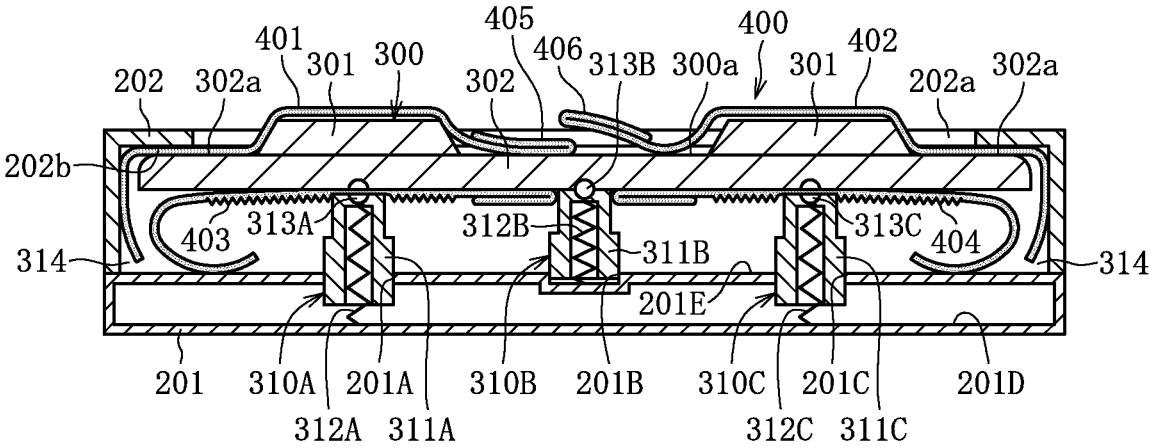
FIG. 11 is a cross-sectional view of the cassette cut along the short-side direction of the cassette and illustrating a state in which setting of the sleeves are completed.
Figure 12:
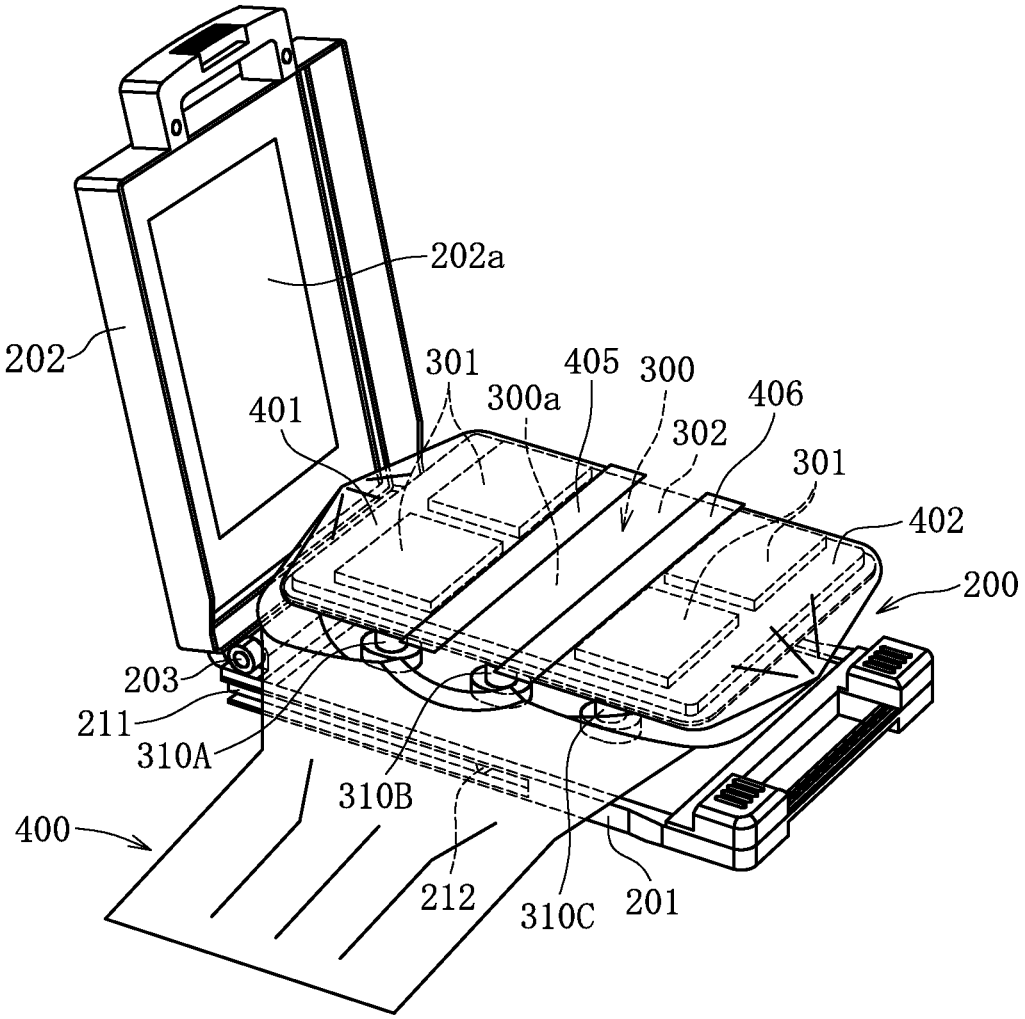
FIG. 12 is a perspective view illustrating a state where sleeves are set in the cassette.

Next, a description is given of a method of setting the cloth 400 in the cassette 200 in the case of printing on a sleeve (cylindrical portion), which is a portion of a T-shirt as the cloth 400. Hereinafter, a specific structure of the T-shirt is described with reference to FIG. 7. Then, a process in which the user sets the cloth 400 in the cassette 200 is described with reference to FIGS. 8 to 12. FIGS. 8 to 11 are cross-sectional views of the cassette cut along the short-side direction of the cassette 200. FIG. 12 is a perspective view in a state where the peripheral cover 202 is opened.

Figure 7:
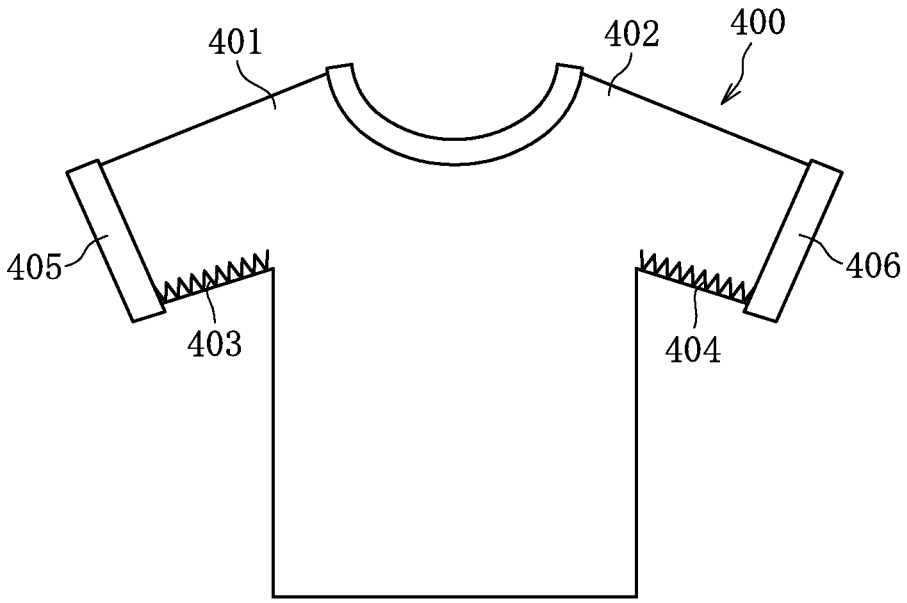
FIG. 7 is a schematic view of an example of a T-shirt set in the cassette.

As illustrated in FIG. 7, the cloth 400 is a T-shirt and includes sleeves 401 and 402 which are tubular portions. The sleeves 401 and 402 have thick stitch perforations (seams) 403 and 404 on the back of the shirt due to the structure of the shirt. Therefore, when the user sets the sleeves 401 and 402 with the front and back sides together on the platen 300, the stitch perforations 403 and 404 protrude from the printing target surface. Accordingly, the stitch perforations 403 and 404 may crease or interfere with the printing device 112, inhibiting preferable printing by the printer 1. Note that, in FIGS. 9 to 11, the stitch perforations 403 and 404 are exaggerated. In addition, cuffs 405 and 406 also have folded portions on sewing and are thicker than other portions of the cloth 400.

Therefore, in the present embodiment, when the user sets the cloth 400 in the cassette 200 for printing on the sleeves 401 and 402, the user sets the sleeves 401 and 402 so that the stitch perforations 403 and 404 and the cuffs 405 and 406 are not on the heat insulators 301.

Figure 8:
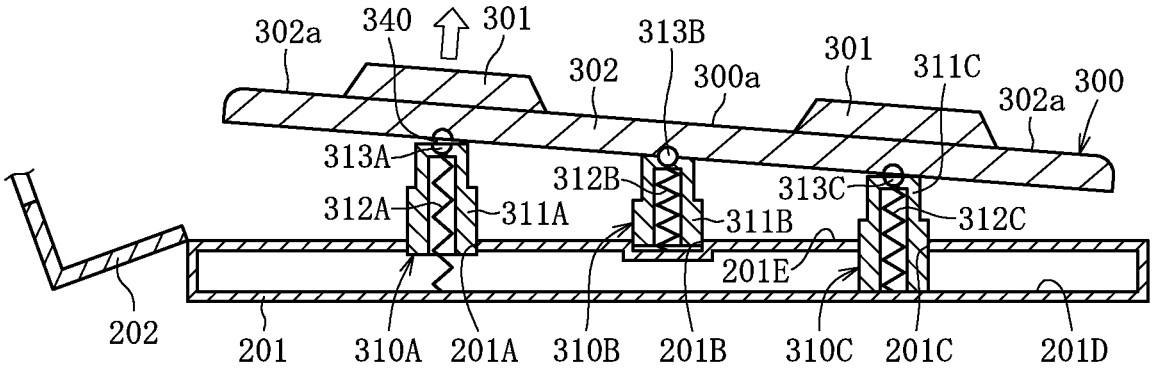
FIG. 8 is a cross-sectional view of the cassette cut along the short-side direction of the cassette and illustrating a state in which a platen of the cassette is pivoted for setting of a sleeve of the T-shirt.

Specifically, as illustrated in FIG. 8, the user lifts the left side of the platen 300 in FIG. 8 (in the direction indicated by an arrow in FIG. 8), with the peripheral cover 202 opened. Thus, the platen 300 is disconnected from the connection part 313A. Further, the platen 300 slightly rotates (pivots) in the clockwise direction in the drawing on the fulcrum 313B. Thus, a gap 340 is secured between the platen 300 and the hollow support part 311A. At this time, the right side of the platen 300 presses the hollow support part 311C downward in FIG. 8. Accordingly, the right side of the platen 300 pushes the hollow support part 311C downward in FIG. 8 against the urging force of the spring 312C.

Figure 9:
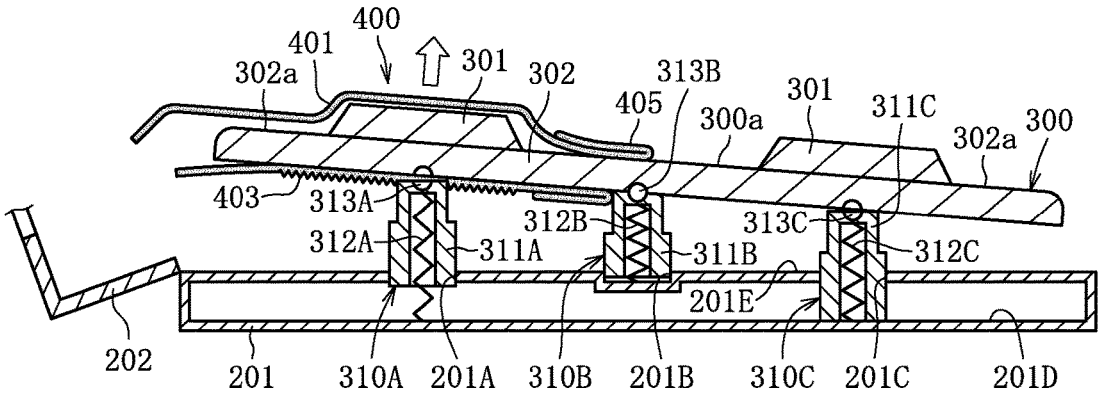
FIG. 9 is a cross-sectional view of the cassette cut along the short-side direction of the cassette and illustrating a state in which the sleeve is set therein.

Then, as illustrated in FIG. 9, the user sets the sleeve 401 of the cloth 400 on the platen 300. Specifically, the user inserts the back of the sleeve 401 into the gap 340 (see FIG. 8), disposes the stitch perforation 404 on this side, and places the front side of the sleeve 401 on the platen 300. Then, the user fits the sleeve 401 on the platen 300 so that the cuff 405 fits in the recessed area 300*a* between the heat insulators 301 and the printing target portion is on the heat insulator 301. Providing the platen 300 pivotable with respect to the platen support 310B confers the following effects. That is, as the platen 300 pivots, a gap can be secured between the platen 300 and the hollow support part 311A (or the hollow support part 311C) in the cassette 200, and the back of the sleeve 401 can be inserted into the gap.

When the setting of the sleeve 401 is completed, the user next puts the sleeve 402 on the platen 300. Specifically, as illustrated in FIG. 10, the user lifts the right side of the platen 300 as indicated by an arrow in FIG. 10. Then, the platen 300 pivots about the fulcrum 313B counterclockwise in the drawing. Thus, the connection between the platen 300 and the connection part 313C is released.

In this state, the user fits the other sleeve 402 of the cloth 400 on the platen 300. Specifically, the user inserts the back of the sleeve 402 into the gap formed between the platen 300 and the hollow support part 311C, and disposes the stitch perforations 404 on this side. At the same time, the user fits the front side of the sleeve 402 on the upper side of the platen 300. Then, the user pulls the sleeve 402 on the platen 300 to the position where the cuff 406 fits in the recessed area 300*a* and the printing target portion is on the heat insulator 301.

Finally, the user pivots the platen 300 clockwise back to the original position. Then, the user closes the peripheral cover 202 and sandwiches the sleeves 401 and 402 between the peripheral cover 202 and the platen 300. Thus, as illustrated in FIGS. 11 and 12, the user can set the sleeves 401 and 402 in the cassette 200. FIG. 12 illustrates a state where the peripheral cover 202 is open.

As described above, according to the present embodiment, the sleeves 401 and 402 can be placed in the cassette 200 from one side and the other side of the platen 300, respectively, and the printing target portions can be placed on the heat insulators 301. Therefore, the printer 1 can print images on both of the sleeves 401 and 402 simultaneously. Thus, the printing efficiency of the printer 1 can be improved. At this time, the user places the back sides of the sleeves 401 and 402 on the back of the platen 300 (the lower side in FIG. 11), so that the sleeves 401 and 402 are placed on the heat insulators 301 while avoiding thick parts. Therefore, the cassette 200 can hold the sleeves 401 and 402 flat on the platen 300. As a result, the printer 1 can properly perform printing on the sleeves 401 and 402.

In addition, a step portion is on the mounting side of the platen 300, that is, the upper side in FIG. 11. Accordingly, the cuffs 405 and 406, which are thick portions, can be placed in the recessed area 300*a*. Therefore, in the cassette 200, the portions of the sleeves 401 and 402 placed on the heat insulators 301 can be in substantially uniform thickness, and the sleeves 401 and 402 can be kept flat on the heat insulators 301. As a result, the printer 1 can properly perform printing on the sleeves 401 and 402. The above-mentioned step portion is formed by the difference in height between the heat insulators 301 and the upper face of the platen body 302.

Further, since the intermediate platen support 310B is secured (may be fixed) to the platen 300, the platen 300 can pivot about the fulcrum 313B relative to the cassette base 201 With this structure, the user can smoothly separate the connection parts 313A and 313C from the platen 300 and insert the back sides of the sleeves 401 and 402 between the platen 300 and the platen supports 310A and 310C. For example, the user need not to completely separate the platen 300 from the cassette base 201. Therefore, the workability of setting the sleeves 401 and 402 in the cassette 200 is improved.

Figure 13:
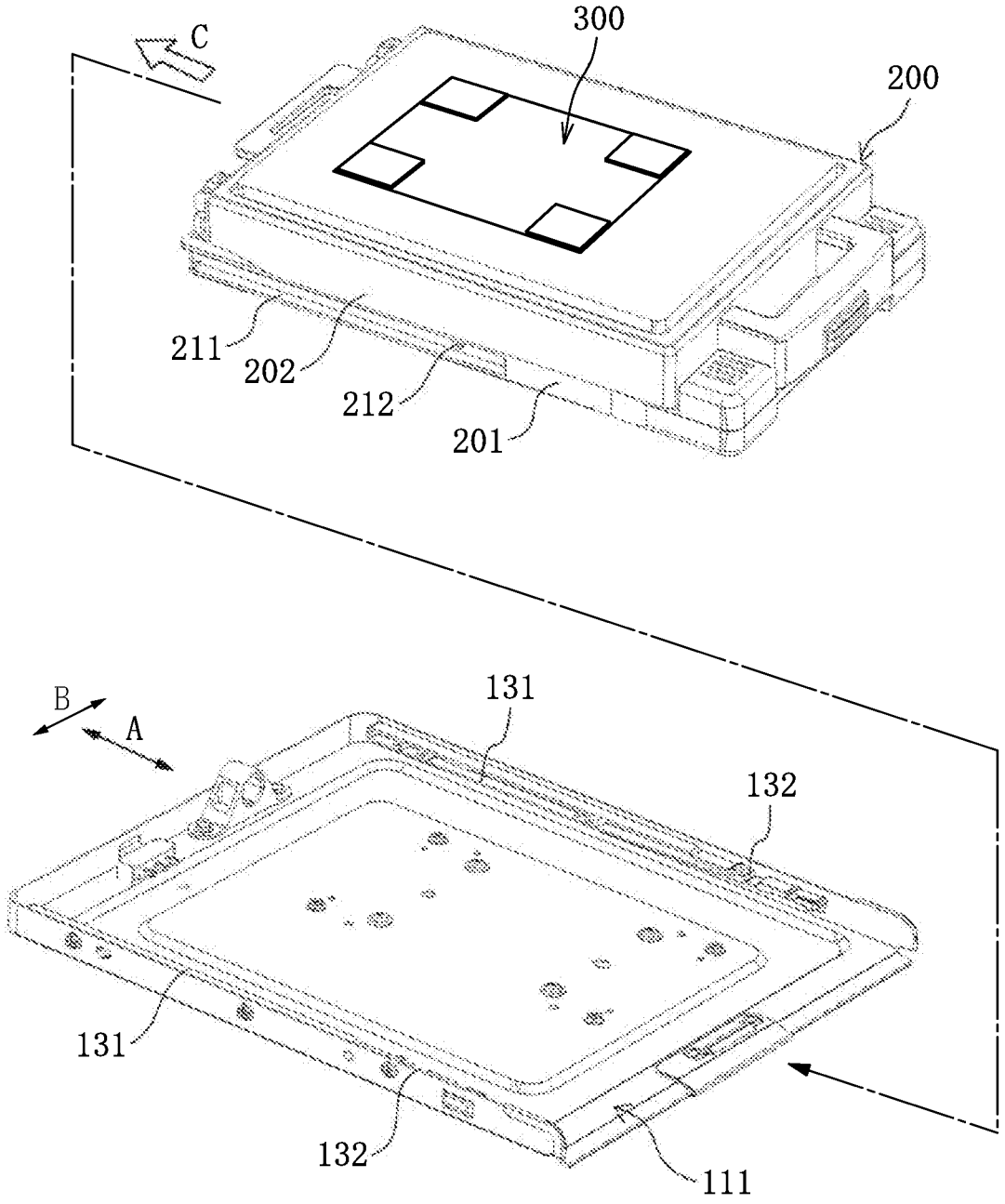
FIG. 13 is a perspective view illustrating configurations of the cassette and a stage thereof.
Figure 14:
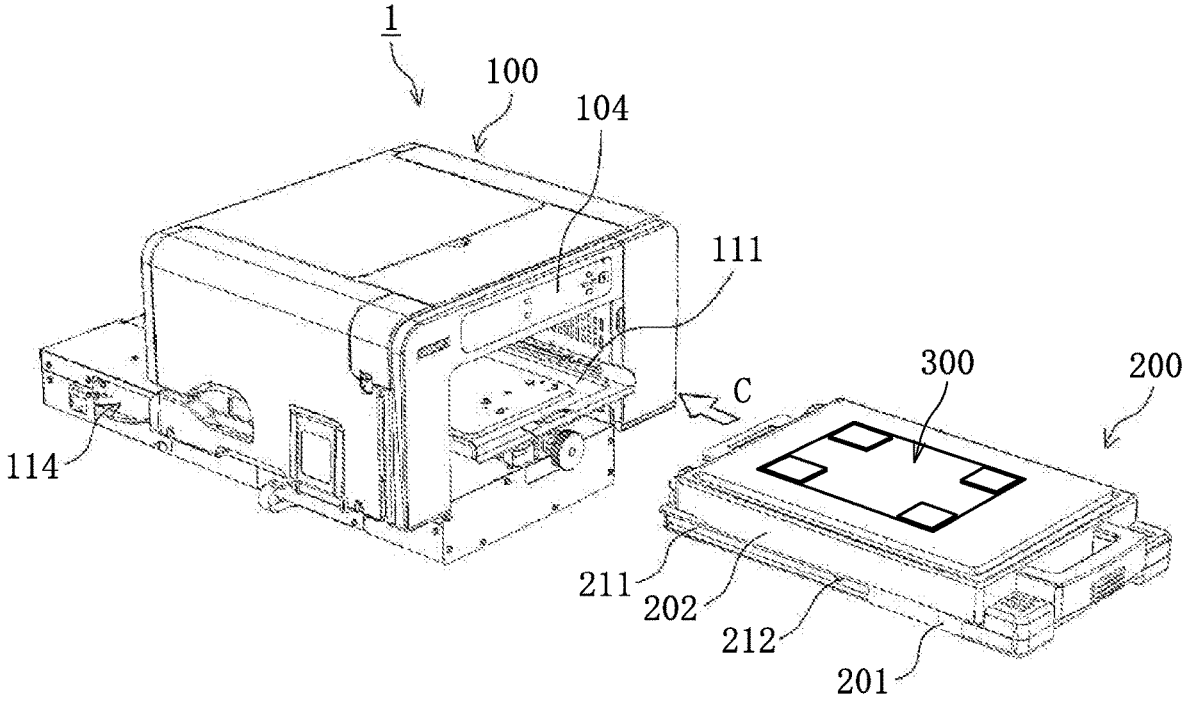
FIG. 14 is a perspective view illustrating mounting of the cassette on the stage.
Figure 15:
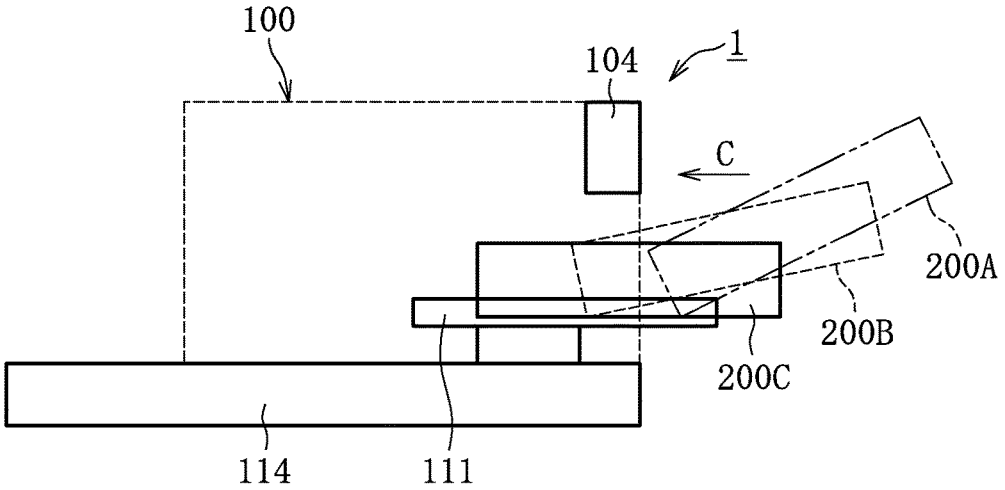
FIG. 15 is a schematic view of the cassette mounted on the stage.

Next, a structure relating to mounting the cassette in the printer is described with reference to FIGS. 13 to 15. FIG. 13 is a perspective view illustrating the cassette and the stage. FIG. 14 is a perspective view illustrating mounting of the cassette on the stage. FIG. 15 is a schematic view illustrating mounting of the cassette on the stage.

The stage 111 of the printer body 100 includes guide rails 131 as illustrated in FIG. 13. The guide rails 131 are disposed on both sides in the arrow B direction orthogonal to the arrow A direction, in which the stage 111 moves. The cassette 200 includes grooves 211 on both sides in the arrow B direction. The guide rails 131 fit in the grooves 211 so as to slide in the grooves 211.

The stage 111 includes recesses 132 disposed on both sides in the arrow B direction orthogonal to the arrow A direction (the stage 111 moves in the arrow A direction). In the arrow A direction, the recess 132 is at the end position of slide between the guide rail 131 and the groove 211. On the other hand, the cassette 200 includes projecting portions 212. The projecting portions 212 fit in the recesses 132 of the stage 111. The projecting portion 212 and the recess 132 are engagement portions for securing the cassette 200 on the stage 111. Specifically, after the user slides the cassette 200 to set the cassette 200 on the stage 111, the projecting portions 212 fit in the respective recesses 132, so that the cassette 200 is secured on the stage 111.

With this configuration, when the cassette 200 is mounted on the stage 111, as illustrated in FIG. 14, the user slides the cassette 200 on the stage 111 in the direction indicated by arrow C, which is along the movement direction of the stage 111 (arrow A direction). Thus, the user can mount the cassette 200 on the stage 111. Note that, in this state, the cloth 400 is held on the platen 300 in the cassette 200.

Referring to FIG. 15, the cassette 200 is mounted as follows.

First, the user tilts the cassette 200 with respect to the stage 111 and places the front end of the cassette 200 on the stage 111, as indicated by a two-dot chain line 200A in FIG. 15. Then, as illustrated by a broken line 200B in FIG. 15, the user pushes and slides the cassette 200 in the direction indicated by arrow C while fitting the grooves 211 of the cassette 200 with the guide rails 131 of the stage 111 (see FIG. 13).

Then, as illustrated by a solid line 200C in FIG. 15, the user pushes the cassette 200 to the slide end position, so that the projecting portions 212 of the cassette 200 fit in the recesses 132 of the stage 111 (see FIG. 13). Thus, the mounting of the cassette 200 on the stage 111 is completed.

At this time, the user can mount the cassette 200 on the stage 111 from the same direction as the moving direction of the stage 111, that is, in the direction in which the stage 111 moves in the printer 1. Therefore, compared to a configuration in which the cassette 200 is mounted on the stage 111 from directly above the stage 111, the printer 1 of the present embodiment can obviate moving the stage 111 to be entirely exposed from the printer body 100. Therefore, the size of the apparatus can be reduced.

Figure 16:
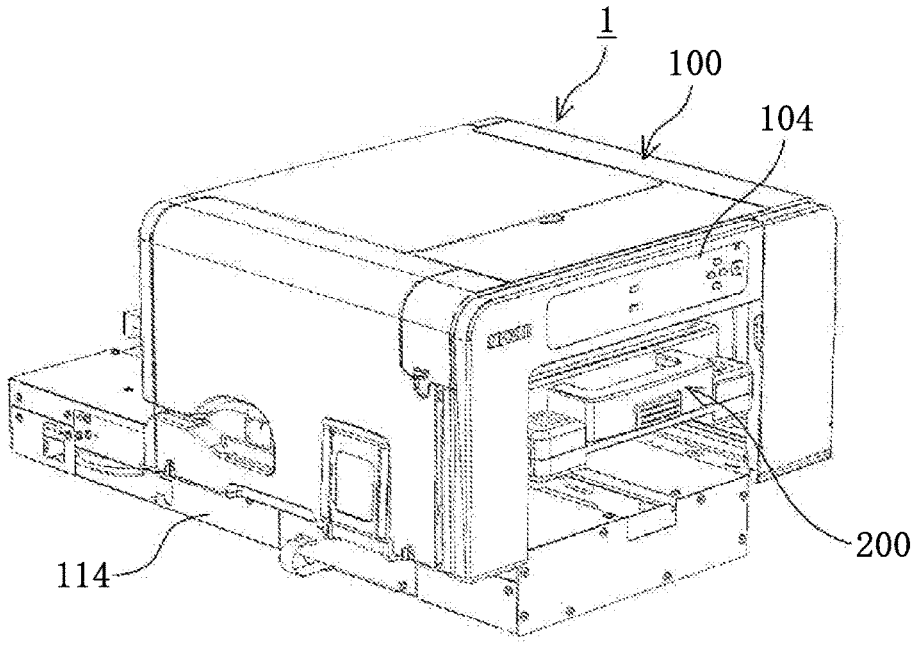
FIG. 16 is an exterior perspective view of the printer and illustrates a state where the cassette is mounted in the printer and the printer is turned off.

Next, a description is given of mounting the cassette in the printer body and turning off the printer, with reference to FIG. 16. FIG. 16 is an exterior perspective view of the printer in which the cassette is mounted.

In response to a command to turn off the power of the printer body 100, a controller of the printer 1 causes the conveyance structure 113 to move the stage 111 to the position where the front side of the cassette 200 is almost at the same position as the front side of the printer body 100, in a plan view as illustrated in FIG. 16. After that, the controller of the printer 1 turns off the power of the printer body 100.

Thus, the printer 1 of the present embodiment occupies a reduced space during standby.

Figure 17:
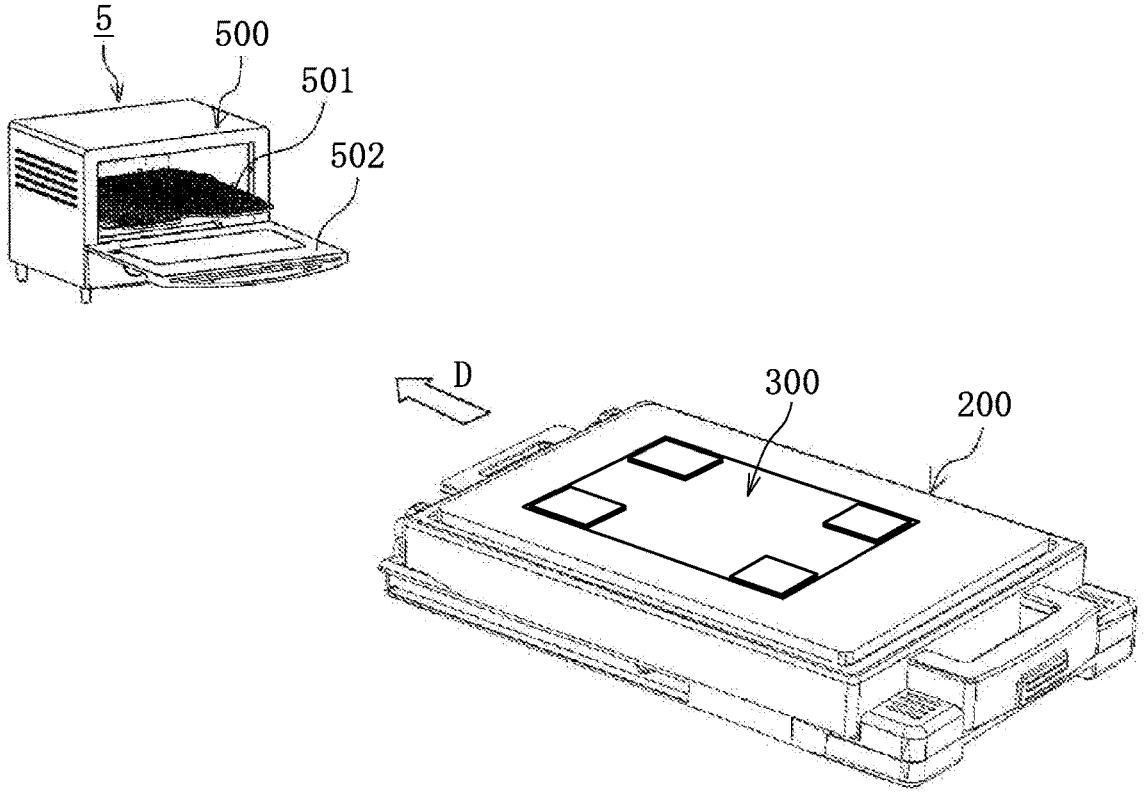
FIG. 17 is a perspective view of an exterior of a thermal fixing device according to an embodiment, to form an image on a cloth.
Figure 18:
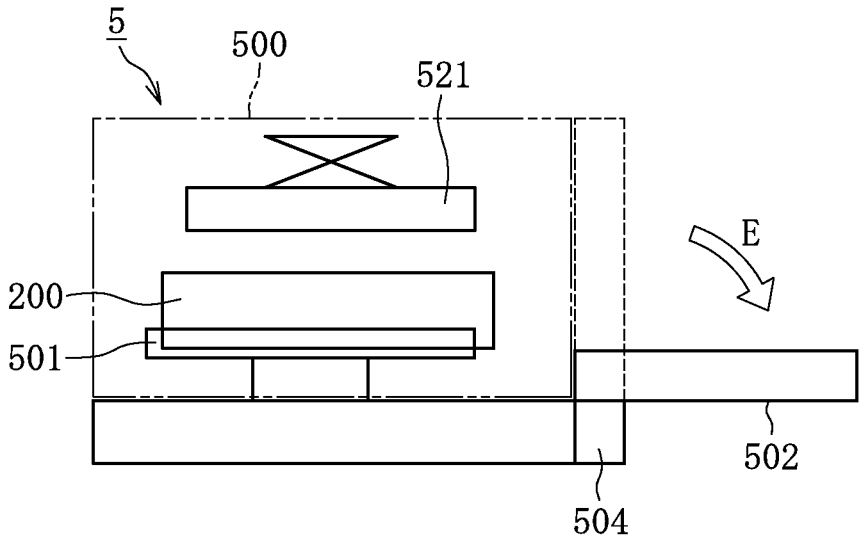
FIG. 18 is a schematic diagram illustrating an interior of the fixing device illustrated in FIG. 17.
Figure 19:
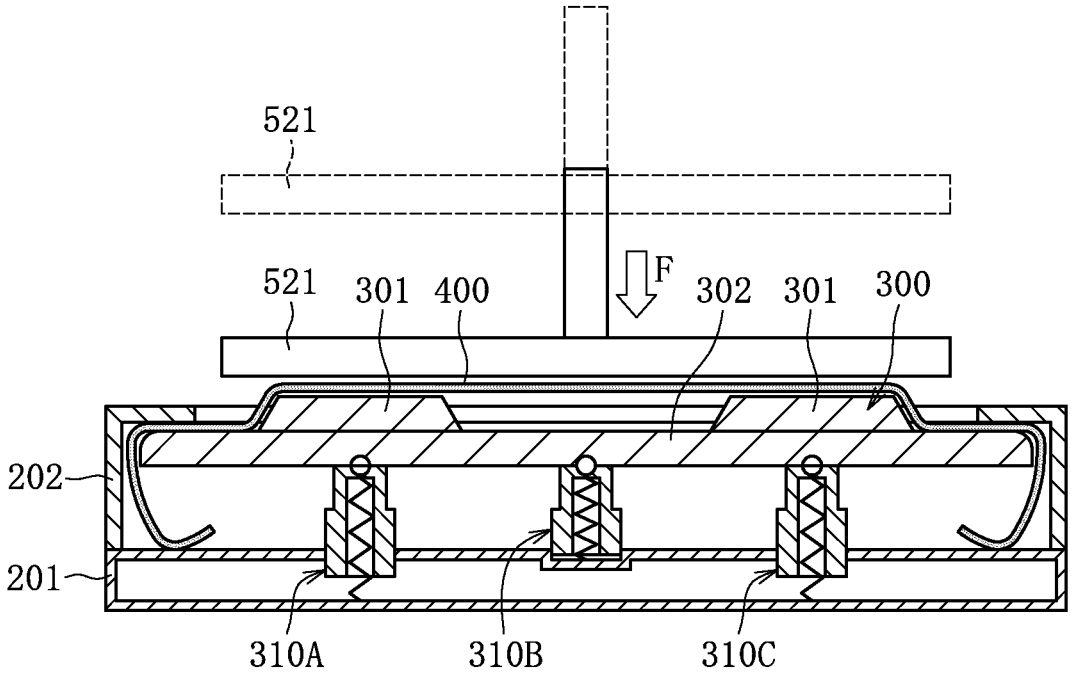
FIG. 19 is a cross-sectional view illustrating a configuration of the fixing device around the cassette cut along the short-side direction of the cassette during a fixing process.

Next, with reference to FIGS. 17 to 19, a description is given of an example of the fixing device that performs heating. The fixing device of a portion of the image forming system (image applying system) according to the present disclosure, to apply an image to the cloth. FIG. 17 is an exterior perspective view of the fixing device. FIG. 18 is a schematic diagram illustrating an interior of the fixing device. FIG. 19 is a cross-sectional view of a configuration of the fixing device around the cassette cut along the short-side direction of the cassette during a fixing process.

The fixing device 5 is configured to heat a cloth. As illustrated in FIG. 17, a body 500 of the fixing device 5 can removably accommodate the cassette 200. The cassette 200 is set in the printer 1 described above.

As illustrated in FIG. 18, the body 500 of the fixing device 5 includes a receiving member 501 (mount), a heat press unit 521 (contact-type heater), a cover 502, an operation portion 504 (operation panel), and the like. In order to fix an image on the cloth 400, the temperature of the heat press unit 521 needs to be as high as 130° C., and more preferably, as high as 150° C. or higher. The cassette 200 is removably mounted on the receiving member 501. The heat press unit 521 presses the cloth 400 in the cassette 200 while heating the cloth 400. The cover 502 is disposed on the front side of the body 500 and openable and closable with respect to the body 500.

The heat insulators 301 of the platen 300 are resistive to the heat of the heating temperature (fixing temperature) of the heat press unit 521 of the fixing device 5.

When the surface of the platen 300 that contacts the cloth 400 is made of a heat insulating material, heat for heating the cloth 400 does not escape into the platen body 302 or inside the cassette 200. Therefore, the fixing device 5 of the present embodiment can efficiently heat the cloth 400.

Further, the heat press unit 521 has such a size that the heat press unit 521 contacts the cloth 400 only in the region of the platen 300 that holds the cloth 400 (in the region of the heat insulators 301).

The operation portion 504 is disposed at a position to be operated by the user only when the cover 502 is closed. Here, the cover 502 is to be pulled down to the front side, and the operation portion 504 is disposed in the lower part of the front side of the body 500.

This structure can prevent the following inconveniences. That is, during the mounting of the cassette 200, the user mistakenly touches the operation portion 504 to activate the heat press unit 521, and the heat press unit 521 contacts the user.

The structure for attaching and removing the cassette 200 to and from the receiving member 501 can be the same as the structure for attaching and removing the cassette 200 to and from the stage 111. The stage 111 serves as a receiving member (mount) to receive the printer 1.

When setting the cloth 400 in the fixing device 5, first, the user takes out the cassette 200 holding the cloth 400 from the printer 1. At this time, an image has been printed on the cloth 400 by the printer 1. Then, as illustrated in FIG. 18, the user opens the cover 502 in the direction indicated by arrow E. Then, the user inserts the cassette 200 onto the receiving member 501 of the fixing device 5 from the direction indicated by arrow D illustrated in FIG. 17. Thus, the receiving member 501 holds the cassette 200. Here, the user sets the cassette 200 on the receiving member 501 by sliding the cassette 200 on the receiving member 501.

Then, as illustrated in FIG. 19, the fixing device 5 lowers the heat press unit 521 in the direction indicated by arrow F. Then, in the fixing device 5, the heat press unit 521 is pressed against the cloth 400 on which the image is printed. The cloth 400 is held by the platen 300.

As described above, the printer 1 and the fixing device 5 of the present embodiment can share the cassette 200 that holds the cloth 400.

Thus, the user can set the cassette 200, with the printed cloth 400 held therein, in the fixing device 5. Therefore, in carrying the cloth 400, the printed surface is not disturbed by creases or overlapped portions of the cloth 400. Thus, workability of the setting of the cloth 400 in the fixing device 5 is improved. Further, it is not necessary to provide a dedicated cassette for each of the printer 1 and the fixing device 5, and the number of components can be reduced.

Since the platen 300 holding the cloth 400 of the cassette 200 has heat resistance against the heating by the fixing device 5, the platen 300 is not deformed by the heat.

Further, although the description above concerns the fixing device 5 employing the heat press unit 521, the configuration is not limited thereto. For example, the fixing device 5 may be configured to heat the cloth in a contactless manner. For example, the fixing device 5 can include a planar radiant-heating heater close to the cloth 400, for example, at about 2 to 3 mm from the cloth 400. The heater heats the surface of the cloth 400 by radiant heating to fix an image on the surface of the cloth 400.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

In the above embodiment, the platen supports 310A and 310C are movable relative to the cassette base 201 in the vertical direction, so that the support height of the platen 300 is variable. In another embodiment, the platen supports 310A to 310C expand and retract in the vertical direction, to change the support height of the platen 300.

Figure 20:
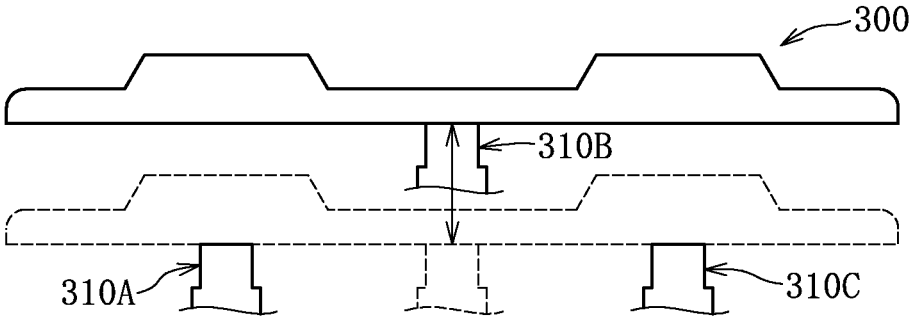
FIG. 20 is a cross-sectional view illustrating a cassette according to a variation.

In the above-described embodiment, the cassette 200 is configured such that, when the user inclines the platen 300, gaps are formed between the platen 300 and the platen supports 310A and 310C, and the back sides of the sleeves 401 and 402 can be sandwiched in the gaps (see FIGS. 8 to 11). Alternatively, as a variation, the cassette 200 can be configured such that a gap is formed between the platen 300 and the platen supports 310A and 310C when the user retreats the platen 300 upward. For example, as illustrated in FIG. 20, in the present variation, the platen 300 is movable between a separated position (represented by a solid line in FIG. 20) and a closer position (represented by a broken line FIG. 20) and can be supported at these positions. The separated position is a first position for setting the sleeves 401 and 402 and farther from the platen supports 310A and 310C (and the cassette base 201). The closer position is a second position for sandwiching the cloth 400 together with the peripheral cover 202 and closer to the platen supports 310A and 310C. The platen support 310B can be expanded and retracted or moved so that the platen 300 can reciprocate between the separated position and the approach position.

In the above embodiment, the printer 1 and the fixing device 5 share the cassette 200, but the present disclosure is not limited thereto. For example, there is a case where, as a pretreatment, the cloth is pressed with a heating member before printing in order to reduce fuzzing of the cloth. In such a case, a pretreatment device (heating device to heat the cloth) and the printer can share the cassette 200. Further, the respective processes of the pretreatment device, the printer, and the fixing device can be performed as an integral process using the same cassette 200.

Alternatively, the printer 1 and the fixing device 5 can be disposed side by side, and consecutive processes can be performed using the cassette 200 in common. By sharing the cassette 200, the connection between the apparatuses can be automated. In addition, by reducing the size of the entire apparatus using the cassette 200, a plurality of apparatuses and devices such as the printer 1 and the fixing device 5 can be integral in one housing.

The above description concerns the printer constituting the image forming system. However, the printer does not necessarily constitute a system together with a heating device to heat the cloth. Aspects of this disclosure are applicable to a stand-alone printer that shares the recording medium holder with a heating device or apparatus that heats the cloth.

The "recording medium holder" in the present disclosure only needs to be attachable to and removable from both of a printer and a heating device, such as a fixing device, that heats the recording medium. Therefore, the shape and the like of the recording medium holder are not limited to the box-shape like the cassette in the above embodiment.

Further, the workability of the printing operation can be improved by eliminating the step of setting the cloth (such as a T-shirt) in the recording medium holder every time the user performs printing. That is, the recording medium holder in which the cloth (T-shirt or the like) is set in advance can be supplied to the printing process. In such a case, the recording medium holder after use is collected and is again supplied to the printing process with another cloth set therein. Thus, the recording medium holder with the cloth preliminarily set therein can be introduced to the market to be traded, as one form of holder with cloth. In the recording medium holder, the cloth (a recording medium) is set with the printing surface of the cloth kept flat.

Alternatively, in order to achieve the same effect as described above, a platen with a cloth preliminarily set thereon can be supplied to the printing process. Specifically, a cloth (such as a T-shirt) is preliminarily set on a platen to be removably mounted in the recording medium holder. For printing on the cloth, a user mounts the platen with the preliminarily set cloth as is in a recording medium holder. Then, after the printing on the cloth by the printer and the image fixing on the cloth by the fixing device are completed, the user removes the platen from the recording medium holder. Then, the user mounts a next platen with a cloth set therein on the recording medium holder. Thereafter, similarly, the printing on the cloth by the printer and the image fixing on the cloth by the fixing device are performed. In such a case, the platen is collected after the fixing, and the platen with another cloth set therein is supplied to the printing process. Similar to the above-described example, the platen with the cloth set thereon can be introduced to the market to be traded, as one form of holder with cloth.

Such a configuration can obviate the work by the user of setting a cloth (e.g., a T-shirt) on the platen every time. Therefore, with such a recording medium holder, continuous processing of a plurality of cloths becomes easy and can be automated.

What is claimed is:

1. A recording medium holder, comprising:

a base;

a platen configured to hold a printing target portion of a recording medium; and a plurality of platen supports disposed side by side in an arrangement direction on the base and configured to support the platen, the plurality of platen supports including:

a first platen support at one end of the plurality of platen supports in the arrangement direction and separable from the platen;

a second platen support at the other end of the plurality of platen supports in the arrangement direction and separable from the platen; and an intermediate platen support disposed between the first platen support and the second platen support, wherein each of the first platen support, the second platen support, and the intermediate platen support includes a spring.

2. The recording medium holder according to claim 1, wherein the intermediate platen support includes a fulcrum configured to pivotably support the platen, and wherein the platen is configured to pivot about a virtual axis relative to the intermediate platen support, the virtual axis passing through the fulcrum and extending in a direction intersecting the arrangement direction of the first platen support and the second platen support.

3. The recording medium holder according to claim 1, wherein the intermediate platen support is configured to move or extend and retract relative to the base in a direction to change a support height of the platen from the base, and wherein the intermediate platen support is configured to support the platen at a first position farther from the base and a second position closer to the base than the first position.

4. The recording medium holder according to claim 1, further comprising a clamp member configured to clamp the recording medium together with the platen.

5. The recording medium holder according to claim 4, wherein the clamp member includes a clamp face on a side of the platen opposite the plurality of platen supports and is configured to sandwich the recording medium together with the platen.

6. The recording medium holder according to claim 4, wherein the clamp member is a cover configured to cover a surface of the recording medium holder.

7. The recording medium holder according to claim 1, wherein the platen includes a step portion on a side of the platen on which the printing target portion is placed.

8. The recording medium holder according to claim 1, wherein the plurality of platen supports is configured to move or extend and retract relative to the base in a direction to change a support height of the platen.

9. An image forming system comprising:

the recording medium holder according to claim 1;

an image forming apparatus configured to form an image on the recording medium held by the recording medium holder; and a heating device configured to heat the recording medium.

10. A recording medium holder, comprising:

a base;

a platen configured to hold a printing target portion of a recording medium; and a plurality of platen supports disposed side by side in an arrangement direction on the base and configured to support the platen, the plurality of platen supports including:

a first platen support at one end of the plurality of platen supports in the arrangement direction and separable from the platen;

a second platen support at the other end of the plurality of platen supports in the arrangement direction and separable from the platen; and an intermediate platen support disposed between the first platen support and the second platen support, wherein the intermediate platen support includes a fulcrum configured to pivotably support the platen.

11. A recording medium holder, comprising:

a base;

a platen configured to hold a printing target portion of a recording medium; and a plurality of platen supports disposed side by side in an arrangement direction on the base and configured to support the platen, the plurality of platen supports including:

a first platen support at one end of the plurality of platen supports in the arrangement direction and separable from the platen; and a second platen support at the other end of the plurality of platen supports in the arrangement direction and separable from the platen;

wherein the plurality of platen supports further includes an intermediate platen support between the first platen support and the second platen support, the intermediate platen support includes a fulcrum configured to pivotably support the platen, and wherein the platen is configured to pivot about a virtual axis relative to the intermediate platen support, the virtual axis passing through the fulcrum and extending in a direction intersecting the arrangement direction of the first platen support and the second platen support.

* * * * *